US009698465B1

(12) United States Patent
Kullman et al.

(10) Patent No.: US 9,698,465 B1
(45) Date of Patent: Jul. 4, 2017

(54) COMMUNICATIONS-TOWER ANTENNA MOUNT

(71) Applicant: Sprint Communications Company L.P., Overland Park, KS (US)

(72) Inventors: Nicholas David Caola Kullman, Seattle, WA (US); Andrew Mark Wurtenberger, Olathe, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 0 days.

(21) Appl. No.: 15/418,237

(22) Filed: Jan. 27, 2017

Related U.S. Application Data

(60) Division of application No. 14/513,598, filed on Oct. 14, 2014, which is a continuation of application No. 13/412,170, filed on Mar. 5, 2012, now Pat. No. 8,896,497.

(51) Int. Cl.
*H01Q 3/02* (2006.01)
*H01Q 1/12* (2006.01)
*H01Q 1/24* (2006.01)

(52) U.S. Cl.
CPC ..... *H01Q 1/1264* (2013.01); *H01Q 1/1228* (2013.01); *H01Q 1/246* (2013.01)

(58) Field of Classification Search
None
See application file for complete search history.

(56) References Cited

U.S. PATENT DOCUMENTS

| | | | | |
|---|---|---|---|---|
| 4,450,450 | A * | 5/1984 | Ellingson | E04H 12/18 343/766 |
| 4,468,671 | A | 8/1984 | Ellingson et al. | |
| 4,473,827 | A | 9/1984 | Ellingson et al. | |
| 5,021,797 | A * | 6/1991 | Dienes | H01Q 21/29 343/727 |
| 5,557,656 | A | 9/1996 | Ray et al. | |
| 5,880,701 | A | 3/1999 | Bhame et al. | |
| 6,028,566 | A | 2/2000 | Pennell et al. | |
| 6,111,553 | A | 8/2000 | Steenbuck | |
| 6,710,751 | B2 | 3/2004 | Ianello | |
| 7,427,962 | B2 | 9/2008 | Yang | |
| 7,642,988 | B1 | 1/2010 | Johnson et al. | |
| 8,641,002 | B2 | 2/2014 | Hand | |
| 2002/0105928 | A1* | 8/2002 | Kapoor | H01Q 1/246 370/334 |
| 2002/0126060 | A1* | 9/2002 | Schadler | H01Q 1/005 343/770 |
| 2004/0032375 | A1 | 2/2004 | Ianello et al. | |
| 2007/0256388 | A1 | 11/2007 | Ianello et al. | |

* cited by examiner

*Primary Examiner* — Trinh Dinh

(57) ABSTRACT

An antenna mount for mounting radio antennas on a communications tower is described. The antenna mount includes a ring structure that encircles the tower and includes a channel disposed about its outer perimeter. The channel is configured to receive a plurality of antenna carriages upon which antennas are mounted on a first end. A second end of the antenna carriage is disposed in the channel and is slideably movable along the length of the channel about the perimeter of the ring structure. The antenna is thus aimable in any desired azimuthal direction by moving the antenna along the ring structure. Bands for communication of data, power, control signaling, and propulsion of the antenna carriages about the ring structure are disposed in the channel. The ring structure may include a junction that allows reorientation of antennas with respect to one another.

10 Claims, 13 Drawing Sheets

COMMUNICATIONS-TOWER ANTENNA MOUNT

CROSS-REFERENCE TO RELATED APPLICATIONS

This application is a divisional of co-pending U.S. patent application Ser. No. 14/513,598, filed Oct. 14, 2014, and titled "Communications-Tower Antenna Mount," which is a continuation of U.S. patent application Ser. No. 13/412,170, filed Mar. 5, 2012, and titled "Communications-Tower Antenna Mount." The entire contents of each of these referenced priority applications are incorporated herein by reference in their entirety.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter.

In brief and at a high level, this disclosure describes, among other things, an antenna mount for mounting radio antennas on a communications tower. The antenna mount includes a ring structure that generally encircles the tower. The ring structures has a substantially C-shaped cross-sectional shape that forms a channel about the outer perimeter of the ring structure and is configured to receive a plurality of antenna carriages. An antenna is coupled to a first end of the antenna carriage. A second end of the antenna carriage is disposed in the channel and can be slideably translated along the length of the channel about the perimeter of the ring structure. The antenna mounted on the antenna carriage can thus be aimed in any desired azimuthal direction by simply moving the antenna to a corresponding location on the ring structure. In embodiments of the invention, one or more features or components for data communications, power provision, control signaling, and propulsion of the antenna carriages about the ring structure are disposed in the channel.

Embodiments of the invention also provide one or more junctions on the ring structure at which relative positions of two or more antennas can be switched with respect to one another. For example, a first antenna can be moved to an opposite side of a second antenna by selectively traversing the junction.

DESCRIPTION OF THE DRAWINGS

Illustrative embodiments of the invention are described in detail below with reference to the attached drawing figures, and wherein.

DETAILED DESCRIPTION

Figure 1:
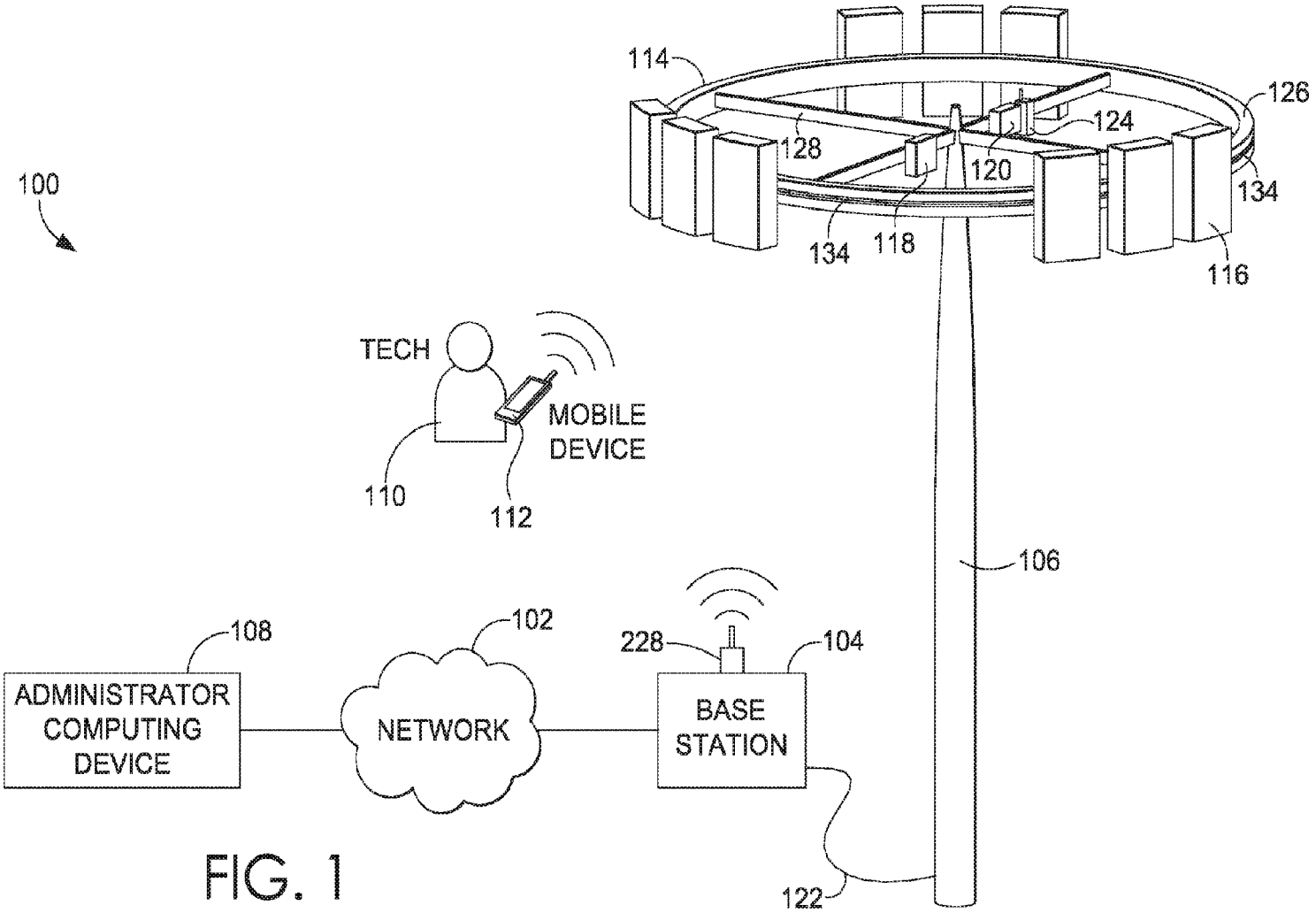
FIG. 1 is a block diagram depicting an exemplary operating environment suitable for use in embodiments of the invention.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

Throughout this disclosure, several acronyms and shorthand notations are used to aid the understanding of certain concepts pertaining to the associated system and services. These acronyms and shorthand notations are intended to help provide an easy methodology of communicating the ideas expressed herein and are not meant to limit the scope of the invention. The following is a list of these acronyms:

PDA Personal Data Assistant
RAS remote azimuth steering
RF radio frequency
LAN local area networks
WAN wide area networks
PSTN public-switched telephone network
GSM Global System for Mobile Communications
CDMA code division multiple access
TDMA time division multiple access
WiMAX Worldwide Interoperability for Microwave Access
HLR home location registry
SMSC short-message service center
MMSC multimedia message service center Further, various technical terms are used throughout this description. An illustrative resource that fleshes out various aspects of these terms can be found in Newton's Telecom Dictionary by H. Newton, 24th Edition (2008).

Embodiments of the invention include apparatus, methods, and systems for mounting, aiming, moving, and organizing antennas on a communications tower. Embodiments of the invention may include or be embodied as, among other things: a method, system, or set of instructions embodied on one or more computer-readable media. Computer-readable media include both volatile and nonvolatile media, removable and nonremovable media, and contemplate media readable by a database, a switch, and various other network devices. Computer-readable media include media implemented in any way for storing information. Examples of stored information include computer-useable instructions, data structures, program modules, and other data representations. Media examples include RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data momentarily, temporarily, or permanently.

By current practices, antennas are mounted on one of three mounting planes that are arranged around a communications tower such as in a triangular configuration. Upon mounting, the antennas are each aimed in a desired compass direction or azimuth. Some antennas include an antenna mount that provides for remote azimuth steering (RAS) in which the antenna can be remotely turned about an axis that is generally parallel to the length of the antenna to alter the azimuthal aim of the antenna. Antenna mounts that enable such remote azimuth steering are heavy, expensive, and only provide a limited range of aiming. Other methods for altering the aiming of the antennas include manual adjustments made by a technician climbing the tower and physically moving the antenna or electronic steering via the radio frequency (RF) transmission/receiving elements in the antenna. These methods can be very expensive and may be limited in their ability to alter the aim of the antenna.

Embodiments of the invention provide and employ an antenna mount that enables infinite or nearly infinite adjustability of the azimuthal aim of antennas mounted thereon without costly and bulky RAS mounts or expensive manual adjustments by technicians. Embodiments of the invention might also reduce the overall weight of components required to be mounted on the communications tower.

Referring initially to FIG. 1, an exemplary operating environment 100 suitable for use in embodiments of the invention is depicted. It should be understood that this and other arrangements described herein are set forth only as examples. Other arrangements and elements (e.g., machines, components, interfaces, functions, orders, and groupings of functions, etc.) can be used in addition to or instead of those shown, and some elements may be omitted altogether. Further, one or more of the elements described herein might be embodied as functional entities that may be implemented as discrete or distributed components or in conjunction with other components, and in any suitable combination and location. Various functions described herein as being performed by one or more entities may be carried out by hardware, firmware, and/or software. For instance, various functions may be carried out by a processor executing instructions stored in memory.

Among other components not shown, the environment 100 generally includes a network 102, a base station 104 communicatively coupled to a communications tower 106, and an administrator's computing device 108. The environment 100 might also include a technician 110 and a mobile device 112.

The components of the environment 100 may communicate with each other via the network 102, which may include, without limitation, one or more local area networks (LANs), wide area networks (WANs), and any available networking configuration useable to communicate between networked computing devices. The network might also include telecommunications networks like a public-switched telephone network (PSTN), Global System for Mobile Communications (GSM), code division multiple access (CDMA), time division multiple access (TDMA), WiFi, Worldwide Interoperability for Microwave Access (WiMAX), or the like. The network may include private or proprietary networks as well as public networks. Such networking environments are commonplace in telecommunications industries, offices, enterprise-wide computer networks, intranets, and the Internet.

It should be understood that any number of administrator computing devices 108, mobile devices 112, and user devices (not shown), among others, may be employed within the environment 100 within the scope of embodiments of the invention. Each may comprise a single or multiple devices cooperating in a distributed environment.

With continued reference to FIG. 1, the administrator's computing device 108 and the mobile device 112 include any computing devices available in the art such as a for example a laptop computer, desktop computer, personal data assistant (PDA) mobile device, or the like. The computing device 108 and the mobile device 112 include one or more processors, memories, busses, input/output devices, and the like as known in the art. Further detail of components and internal functionality of the computing device 108 or the mobile device 112 is not necessary for understanding embodiments of the invention, and as such, is not described herein. The computing device 108 is communicatively coupled to the network while the mobile device 112 may be communicatively coupled to the network and/or may be coupled directly, either wirelessly or through a hardwire connection, to the tower 106. In an embodiment, a plurality of computing devices 108 and/or mobile devices 112 is included in the network.

The base station 104 comprises any components useable to receive, handle, transmit, and/or operate on data received via the network 102 or from components on the communications tower 106. In an embodiment, the base station 104 is a base transceiver station. The base station 104 is configured like base stations known in the art and thus may include or be communicatively coupled to components such as a home location registry (HLR), a short-message service center (SMSC), a multimedia message service center (MMSC), signal processors, routers, control electronics, power sources, and the like. Further detail of components and functionalities of the base station 104 in addition to those described below will be understood by one of skill in the art and are thus not described in detail herein.

The data received and transmitted by the base station 104 over the network and via the components on the tower 106 includes voice and/or data communications for transmission to, or receipt from a wireless communications network by methods known in the art. The data might also include control signaling for operation of components mounted on the tower 106 as described below.

The base station 104 is communicatively coupled to components mounted on the communications tower 106. The tower 106 includes an antenna mount 114 with a plurality of antennas 116 mounted thereon for broadcasting voice or data signals to a plurality of mobile user devices (not shown) or other receiving units. Any configuration of components necessary for transmitting signals from the base station 104 through the antennas 116 mounted on the tower 106 may be employed in embodiments of the invention. For example, antennas 116 are associated with one or more radio units 118 and control units 120 that may be included in the base station 104 or mounted at the base or top of the tower 106 with the antennas 116.

One or more cables 122, wires, fiber-optic lines, or other communicative couplings extend from the base station to the tower 106 and up the tower 106 to the one or more of the radios 118, control units 120, antennas 116, or other components disposed on the tower 106. In an embodiment, a wireless transceiver 124 is disposed on the tower 106 for wireless communication of one or more signals to/from the base station 104 or to/from the technician's mobile device 112 to one or more of the radios 118, control units 120, antennas 116, or other components mounted on the tower 106. In an embodiment, the base station 104 might include a transmitter 228 that provides such wireless communications with the transceiver 124.

The tower 106 can comprise any available tower structure known in the art, such as, for example and not limitation, a mast, a tower, a steel lattice structure, a concrete reinforced tower, a guyed structure, a cantilevered structure, or the like. Or the tower 106 might comprise other structures like a church steeple, a geologic structure, a building, or other structure cable of supporting the antenna mount 114 of embodiments of the invention described herein.

With additional reference to FIGS. 2-6, the antenna mount 114 is described in accordance with an embodiment of the invention. The antenna mount 114 comprises a ring or generally circular structure 126 mounted on the tower 106. The ring structure 126 can be mounted at the top or at any point along the length of the tower 106 and substantially encircles the tower 106. One or more spokes 128 extend radially outward from the tower 106 to the ring structure 126 and couple the ring structure 126 to the tower 106. One or more of the spokes 128 includes a passageway 130 interior to the spoke 128 and traversing the length of the spoke 128. The passageway 130 is configured to receive cables 132, wires, fiber optic strands, or other communications components therein.

Figure 5:
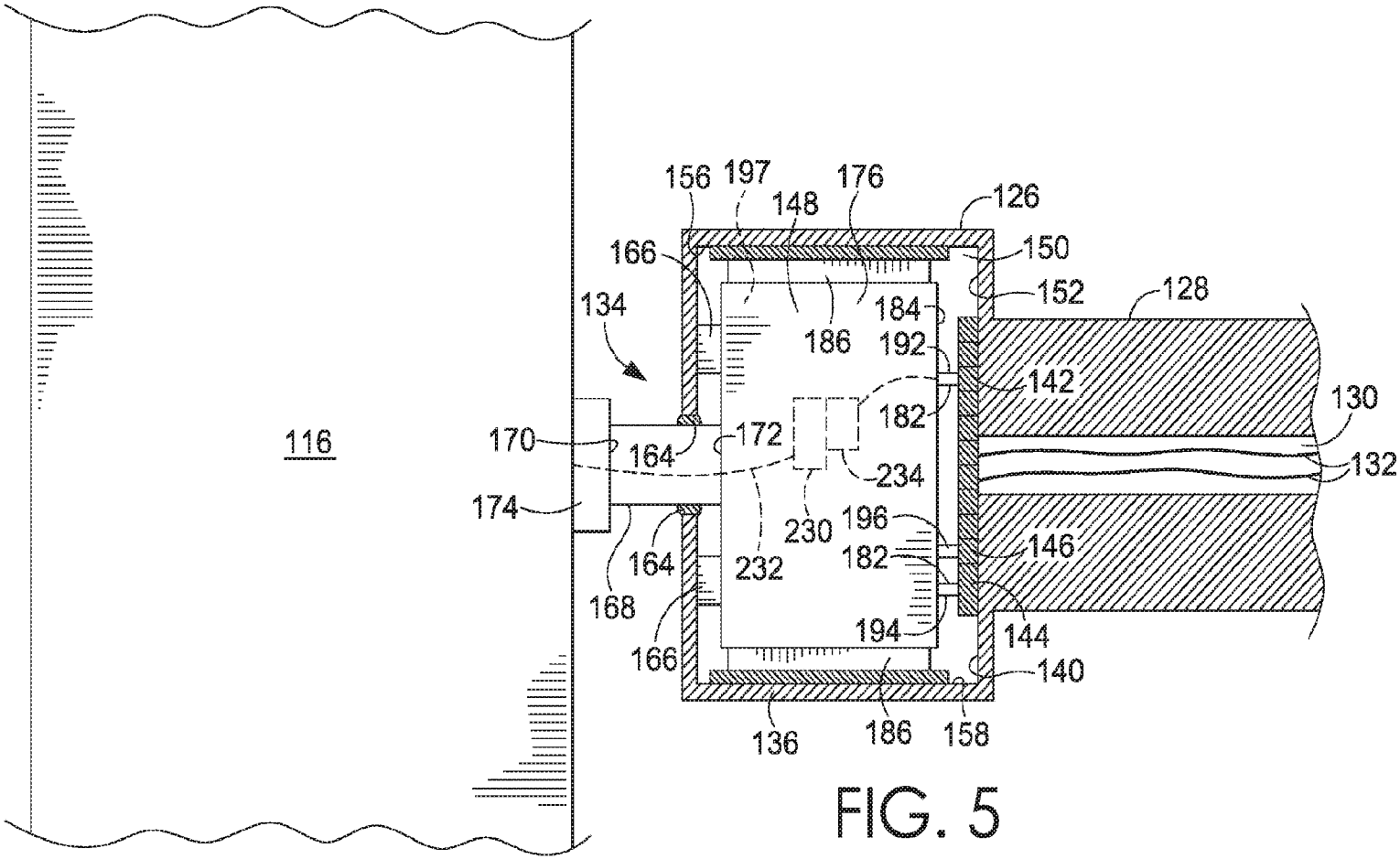
FIG. 5 is a cross-sectional elevational view of the antenna mount of FIG. 4 in accordance with an embodiment of the invention.

The ring structure 126 is generally circular in shape but may comprise any form or shape that substantially encircles the tower 106. In an embodiment the ring structure 126 only encircles a portion of the tower 106. The ring structure 126 has a generally C-shaped cross section that forms a channel 134 disposed therein that is open to the environment generally along the perimeter of the ring structure 126, as best depicted in FIG. 5. The channel 134 extends into a body 136 of the ring structure 126.

Figure 4:
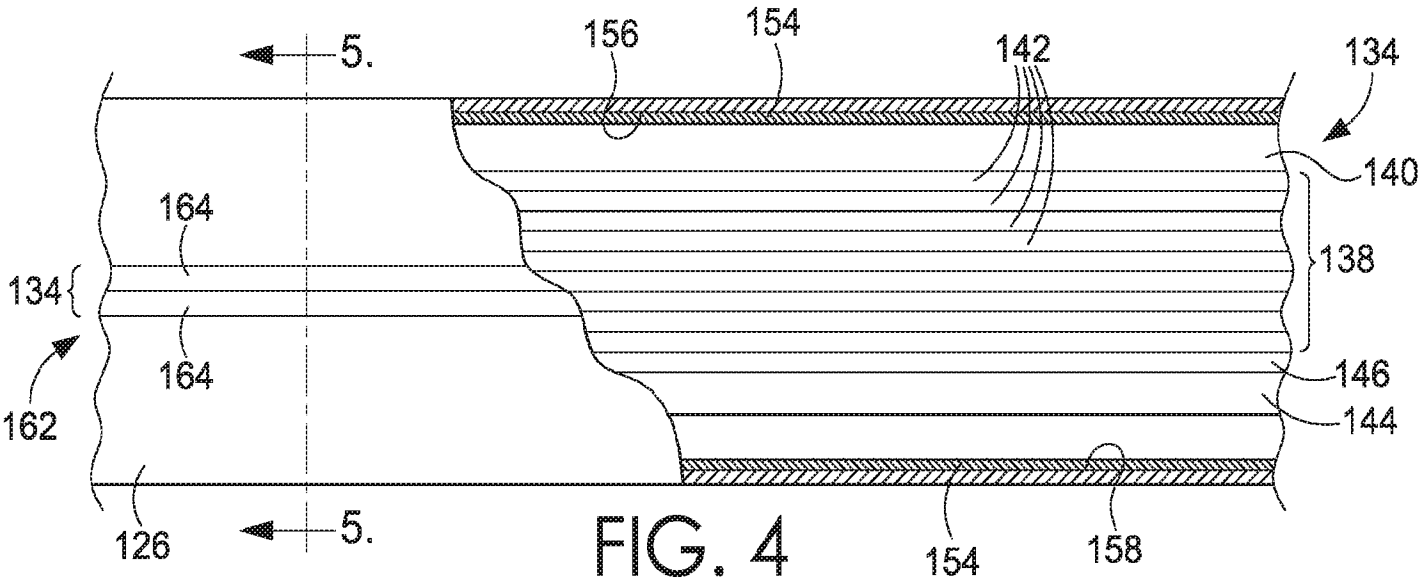
FIG. 4 is a partial cut-away elevational view of a portion of an antenna mount in accordance with an embodiment of the invention.

As depicted in FIG. 4, within the channel 134 is disposed a plurality of metallic bands 138. The metallic bands 138 are disposed on an interior surface 140 of the channel 134 and are coupled a respective cable 132 that extends within the passageway 130 of a spoke 128 to the tower 106. A plurality of the metallic bands 138 comprise communications bands 142 through which data for broadcast or that is received by an antenna 116 is communicated. One or more of the bands 138 comprises a power band 144 that is coupled to a cable 132 that extends through the spoke 128 to a power source (not shown) associated with the tower 106. The power source comprises any electrical power source known in the art, such as, for example a generator, local power grid, solar cell, or the like. In an embodiment, one or more of the bands 138 might also comprise a control band 146 via which control signals for operation or movement of antenna carriages 148, as described below, are provided.

Figure 6:
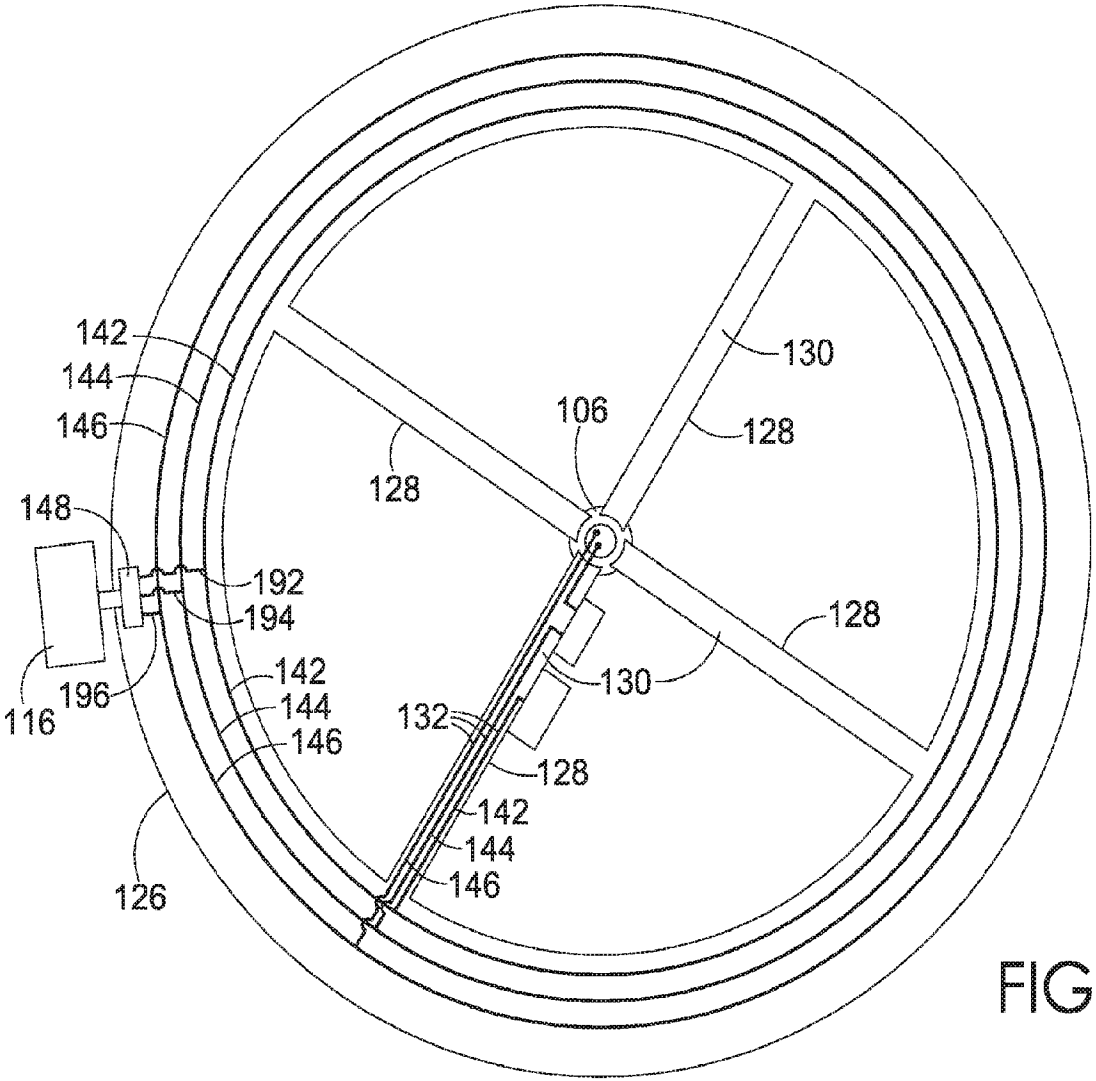
FIG. 6 is an illustration depicting electrical and communications couplings in an antenna mount in accordance with an embodiment of the invention.

The metallic bands 138 comprise any materials such as aluminum, copper, gold, or the like and are disposed within the channel 134 by any desired means. For example, the metallic bands 138 might be disposed on one or more of an interior surface 140 of the channel 134, on integrated circuit board, or on another component that is installed in the channel 134 using one or more of adhesives, fasteners, coatings, or the like. In an embodiment, an interior portion 150 of the channel 134 comprises a rectangular cross sectional shape as depicted in FIG. 5. In such an embodiment, the metallic bands 138 might be disposed along an interior back face 152 of the channel 134 and run parallel to one another. In another embodiment, the metallic bands 138 are disposed on any face on the interior 150 of the channel 134. The bands 134 encircle the tower 106 as depicted in FIG. 6. Or, in an embodiment, the bands 134 might be segmented into one or more segments that encircle only a portion of the tower 106.

Figure 7:
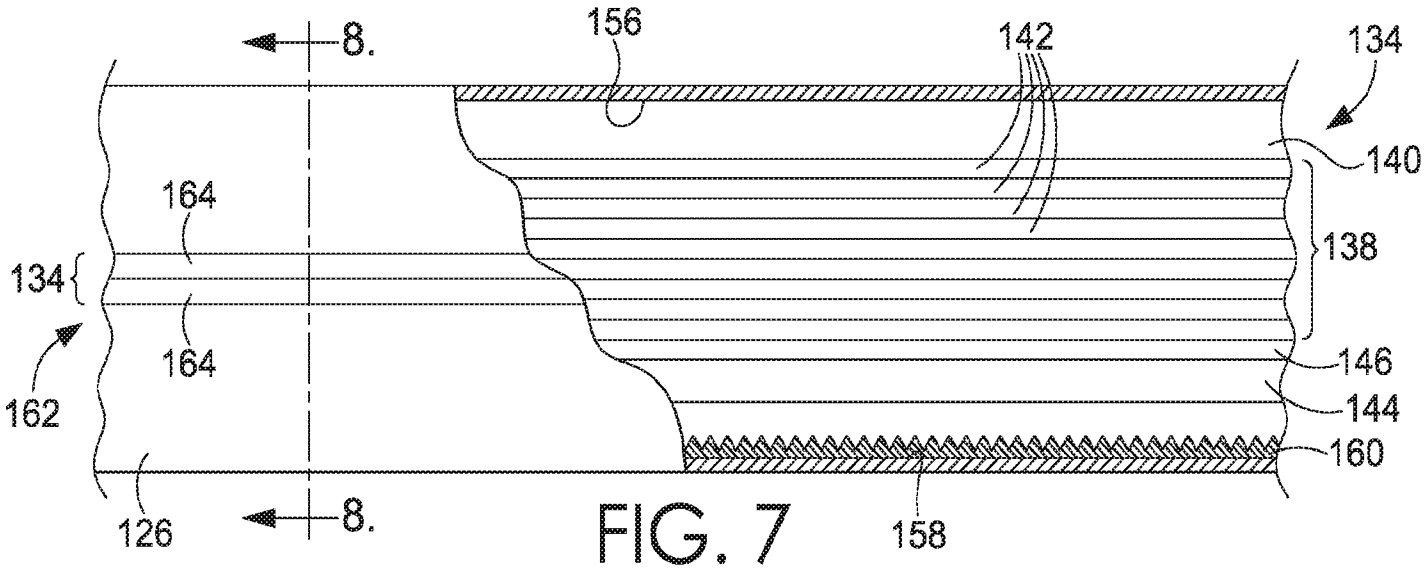
FIG. 7 is a partial cut-away elevational view of a portion of an antenna mount with mechanical propulsion features disposed therein in accordance with an embodiment of the invention.
Figure 8:
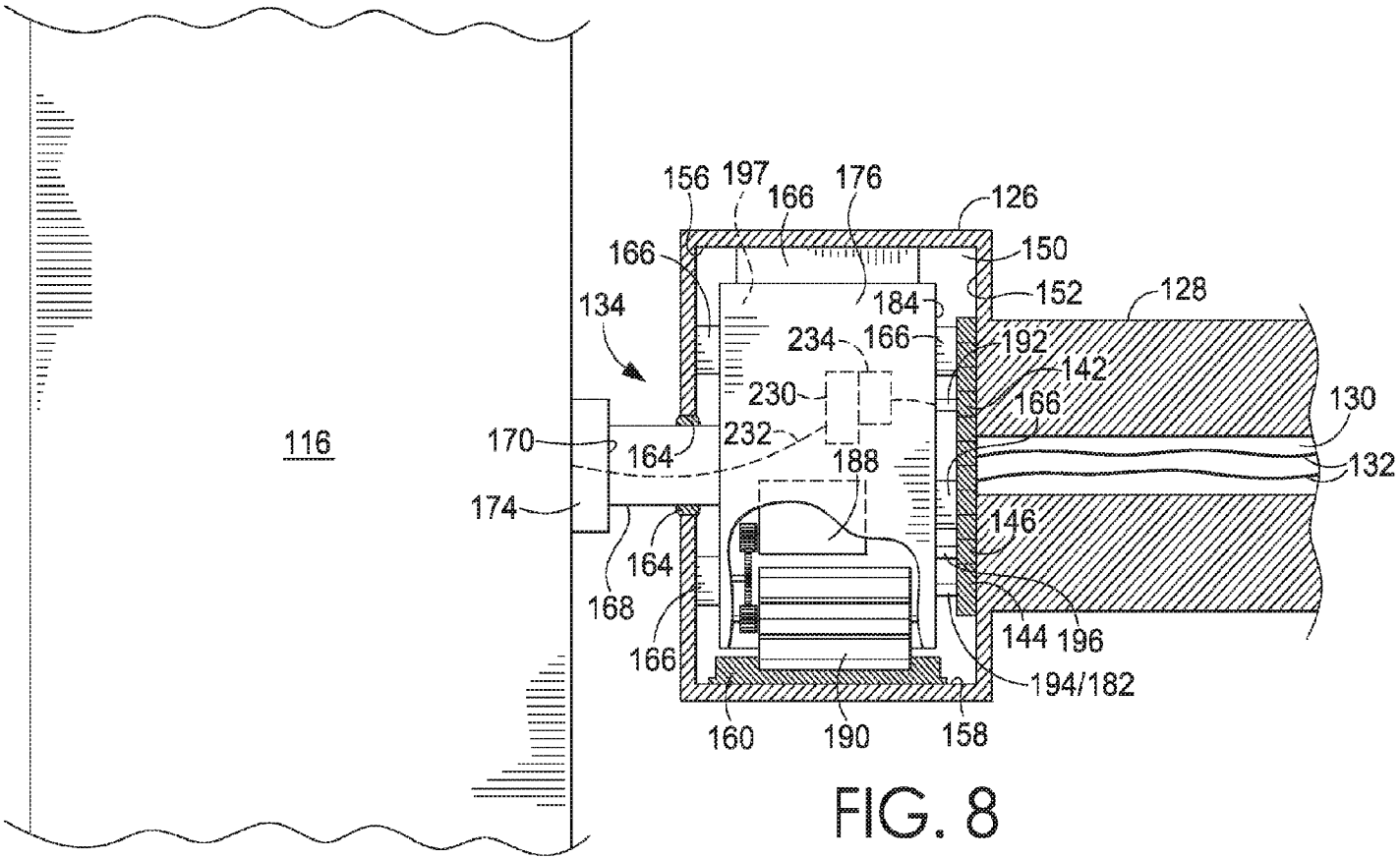
FIG. 8 is a cross-sectional elevational view of the antenna mount of FIG. 7 in accordance with an embodiment of the invention.

The channel 134 also includes one or more features 154 disposed therein for propelling the antenna carriage 148 along the length of the channel 134. The features 154 might include one or more magnets, electromagnets, gears, or toothed faces, among other available propulsion features. As depicted in FIGS. 4-5, the propulsion components are disposed on upper and lower surfaces 156, 158 of the interior 150 of the channel 134, however, such components might be disposed on any surface of the channel 134. As shown in FIG. 4, the propulsion components comprise electromagnetic propulsion components, e.g. electromagnets. Alternatively, as depicted in FIGS. 7-8, the propulsion components include a toothed face 160 along the bottom face of the channel 134. In an embodiment, the toothed face is configured similarly to a rack in a rack-and-pinion configuration.

Adjacent to an open mouth portion 162 of the channel 134 are disposed one or more sealing components 164 that close off the open mouth portion 162 of the channel 134 to the environment outside of the channel 134 and the ring structure 126. The sealing components 164 are configured to allow the antenna carriage 148 to pass between the sealing components 164 and to slide therebetween while also substantially sealing the channel 134 around the antenna carriage 148. In an embodiment, the sealing components 164 include one or more gaskets, flanges, or the like comprised of a rubber or elastomeric compounds among others.

Within the interior portion 150 and/or within the open mouth 162 of the channel 134 might be disposed one or more bearing surfaces 166. The bearing surfaces 166 include any available bearing materials and components available in the art. For example, the bearing surfaces might include ball bearings, cylindrical bearings, or bearing pads constructed from a nylon, brass, or other material.

A lubricant might also be disposed with the interior 150 of the channel 134. The lubricant can be configured to aid in movement of the antenna carriage 148 along the channel 134. The lubricant may aid in conduction of signals from the metallic bands 138 or in insulating the metallic bands 138 from one another. The lubricant might also protect components disposed in the channel 134 from one or more environmental elements like ice, water, dust, or the like.

With continued reference to FIG. 5, the antenna carriage 148 comprises an elongate body 168 having a first and a second end 170, 172. The first end 170 is configured to connect to an antenna coupling 174. In an embodiment, the antenna coupling 174 is integral with the first end 170. The antenna coupling 174 comprises any available antenna mounting device or configuration available in the art. The antenna coupling 174 might be configured to enable manual or remote adjustment of the pitch, azimuth, and/or rotation of the antenna 116. The pitch being rotation of the antenna about an axis perpendicular to the length of the antenna, e.g. upward and downward rotation with respect to the ground. The azimuth being rotation of the antenna about an axis generally parallel to the antenna's length, e.g. side-to-side rotation. And the rotation being turning of the antenna about an axis extending from the tower through the antenna 116, e.g. clockwise or counter-clockwise turning of the antenna 116 about the antenna coupling 174. Remote adjustment of the antenna can be wireless or wired communication with the antenna coupling 174, a controller associated with the antenna coupling 174, or a controller at the base station 104 via a network communication.

Figure 9A:
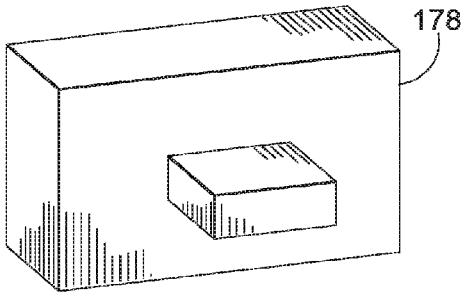
FIGS. 9A-B are perspective views of antenna carriages in accordance with embodiments of the invention.
Figure 9B:
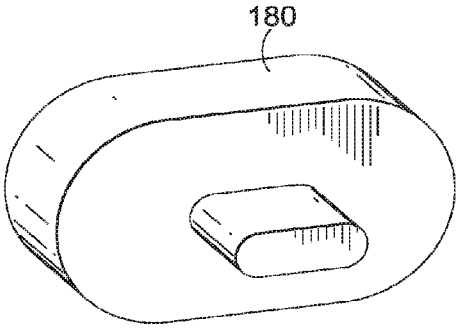

The second end 172 of the antenna carriage 148 includes an enlarged portion 176 configured to fit within the channel 134. The enlarged portion 176 can comprise any desired shape and form that is compatible with the cross-sectional shape of the channel 134. In an embodiment, as depicted in FIG. 9A, an enlarged portion 178 comprises a substantially cubical or rectangular-cubical form. Or as depicted in FIG. 9B an enlarged portion 180 comprises an ovular form.

The enlarged portion 176 includes one or more contacts 182 that comprise a protuberance along a surface 184 of the enlarged portion 176 or a component that extends from the surface 184 of the enlarged portion 176 to contact and communicatively or electrically couple to one or more of the metallic bands 138 disposed within the channel 134. In an embodiment, the contacts 182 are configured to maintain the coupling with the metallic bands 138 during movement of the antenna carriage 148 along the channel 134 by sliding along the surface of the metallic bands 138. The contacts 182 on the enlarged portion 176 include one or more communication contacts 192 that couple to a respective one or more of the communications bands 142 and a power contact 194 that couples to the one or more power bands 144 disposed in the channel 134. In an embodiment, the enlarged portion 176 might also include a control contact 196 that couples to the control band 146 in the channel 134.

One or more propulsion components 186 might be disposed on a surface of the enlarged portion 176. The propulsion components 186 might include any component necessary for propelling the antenna carriage 148 through the channel 134 and configured for use with the propulsion features 154 installed in the channel 134. For example, one or more magnets might be mounted on the enlarged portion 176 as depicted in FIG. 5. Or, as depicted in FIG. 8, an electric motor 188 and a pinion gear 190 might be disposed within the enlarged portion 176 and configured to couple to a toothed rack or face 160 of the channel 134.

In an embodiment, one or more bearings or bearing faces (not shown) are also disposed on the enlarged portion 176 for assisting movement of the enlarged portion 176 within the channel 134 and for supporting the antenna carriage 148 within the channel 134.

In an embodiment, one or more components 230 useable to instruct transmissions by the antenna 116 can be disposed within the enlarged portion 176, along the body 168 of the antenna carriage 148, at or near the antenna coupling 174, or on the antenna 116 itself. The antenna carriage 148 might include a hollow interior portion 197 in which such components 230, wires 232, cables, electric motors, gears, or the like are disposed. Such components may facilitate communication of data to or from the antenna 116. And they are useable to control or operate movement of the antenna carriage 148 about the ring structure 126.

Figure 3:
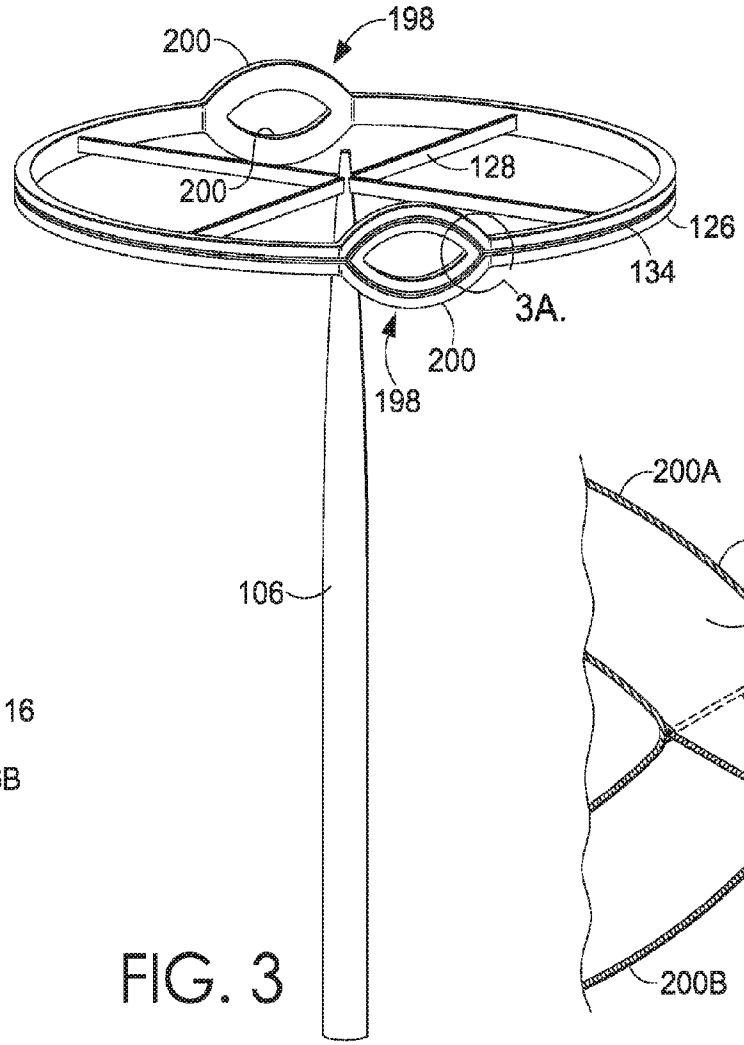
FIG. 3 is a side perspective view of a communications tower with an antenna mount in accordance with an embodiment of the invention.

With reference now to FIGS. 2-3 and 10-11, embodiments of the ring structure 126 include one or more junctions 198. The junction 198 comprises one or more divergent paths 200A-B for the channel 134. As depicted in FIG. 3, the ring structure 126 is mounted in a substantially horizontal plane with respect to the vertically standing tower 106. At the junction 198 the channel 134 splits vertically into two divergent paths 200A-B that form a substantially circular or ovular junction 198. In embodiments, the junction 198 comprises any desired form such as a diamond (FIG. 10A), square (FIG. 10B), rectangular, elongate oval (FIG. 10C), or T-shape or dogleg (FIG. 10D).

The channel 134, within the junction 198, follows both of the divergent paths 200A-B. In an embodiment, all of the components within the channel 134 follow both divergent paths 200A-B. In another embodiment, one or more of the components in the channel 134 are not included within the junction 198. For example, the communications bands 142 might be omitted from the channel 134 in the junction 198.

The junction 198 is configured to enable a first antenna 116A to be moved along a first path 200A while a second antenna 116B is moved along a second path 200B. Thereby, the positions of the first and second antennas 116A-B can be altered.

The first and second antennas 116A-B are the same as the antenna 116 described previously—the antennas 116A-B, and any other components provided with A and B designations herein, are denoted A and B only to distinguish between two like components and to simplify description of their movements. But such is not intended to indicate that the antennas 116A-B are the same type or configuration of antenna—the antennas 116A-B need not be of the same type or configuration. The position, orientation, and movements of the antennas 116A-B are described below as being left, right, up, or down with respect to the drawings and are indicated by arrows, where appropriate, in the drawings. For example, if the first antenna 116A is mounted to the right side of the second antenna 116B, the junction 198 enables the first antenna 116A to be repositioned on the left side of the second antenna 116B while both the first and second antennas 116A-B remain mounted on the ring structure 126. Further, movements of the antennas 116A-B are described herein with reference to the antennas 116A-B and their respective antenna carriages 148A-B. Such references are used interchangeably herein unless specified otherwise, e.g. movement of the antenna 116 might also be referred to as movement of the antenna carriage 148.

Figure 3A:
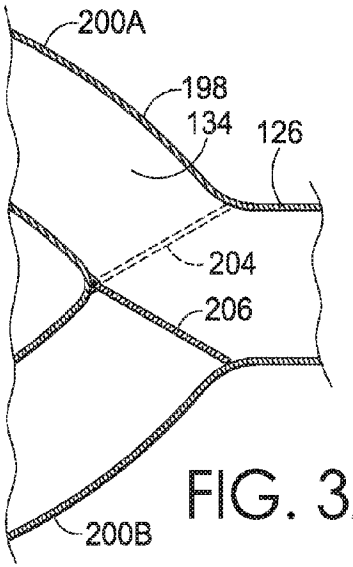
FIG. 3A is a partial cross-sectional view of a portion of the communications tower of FIG. 3 depicting an interior of a channel of the antenna mount in accordance with an embodiment of the invention.
Figure 2:
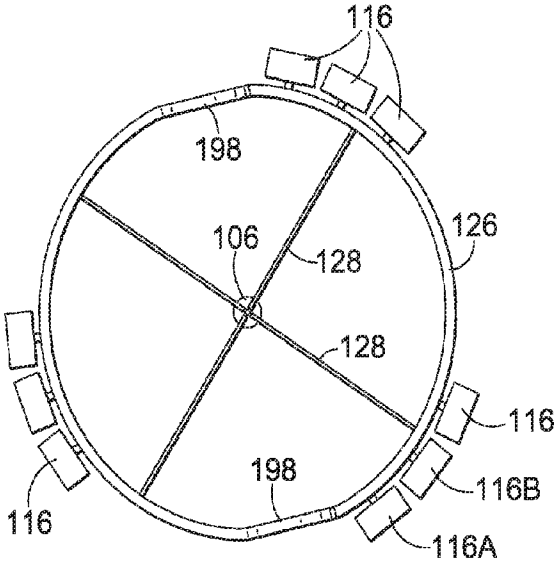
FIG. 2 is a top plan view depicting a communications tower with an antenna mount in accordance with an embodiment of the invention.

In an embodiment, within the channel 134 at the junction 198 there is disposed a means for steering the antennas 116A-B on the first or second paths 200A-B. For example, as depicted in FIG. 3A, a hinged flange 206 might be disposed within the channel 134 to divert the travel of the antennas 116A-B along the first path 200A. The flange 206 might also be moveable to a second position 204 to divert the second antenna 116B onto the second path 200B. In another embodiment, the hinged flange 206 might be electromechanically or mechanically moveable to selectively steer the antennas 116A-B onto the first or second paths 200A-B. In another embodiment, other means might be used to steer the antennas 116A-B along a path 200A-B. For example, the electromagnetic propulsion or mechanical propulsion might be configured to steer the antennas 116A-B into the first or second paths 200A-B.

Figure 11A:
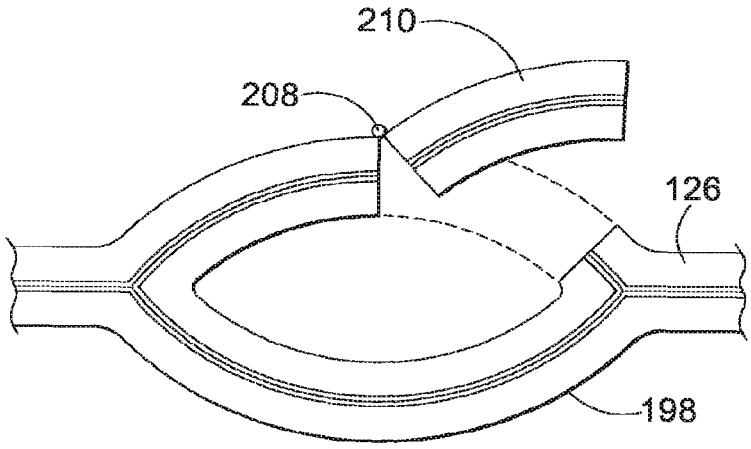
FIGS. 11A-C are elevational views of an antenna mount having a removable or hingeable portion in accordance with an embodiment of the invention.
Figure 11B:
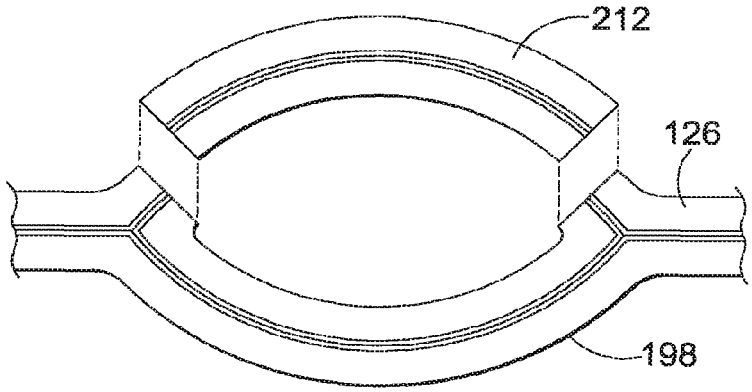
Figure 11C:
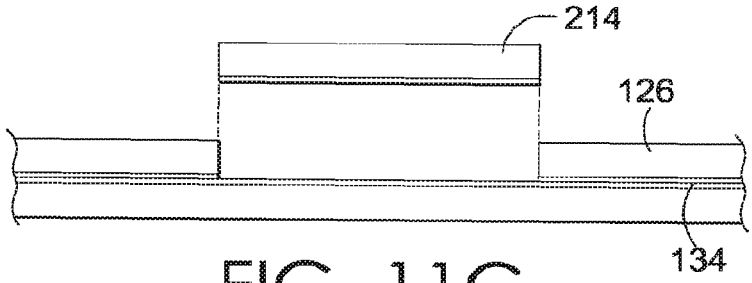

The ring structure 126 also includes one or more features to enable installation of the antenna carriages 148 into the ring structure 126. As depicted in FIG. 11A, the ring structure 126 might include one or more hinges 208 at which a portion 210 of the ring structure 126 hingedly pivots away from the ring structure 126 to expose the channel 134. The hinged portion 210 might be disposed in a portion of the junction 198, as depicted in FIG. 11A, or might be located at another point along the ring structure 126. In another embodiment, a portion 212 of the junction 198 or ring structure 126 might be removable to allow installation of the antenna carriage into the channel as depicted in FIG. 11B. In yet another embodiment, depicted in FIG. 11C, a top portion 214 of the ring structure 126 might be removable to expose the channel 134 for disposal of the antenna carriage 148 therein.

With respect now again to FIGS. 1-3, the operation of the antenna mount 114 is described in accordance with an embodiment of the invention. Initially the ring structure 126 is mounted on a communications tower 106 along with the appropriate radios 118, controllers 120, and the like. The ring structure 126 and the radios 118, controllers 120, and the like are communicatively coupled to the base station 104. The ring structure 126 is coupled to the tower 106 via the one or more spokes 128. Additional support structures (not shown), e.g. trusses or guy wires coupled between the spokes 128 or ring structure 126 and the tower 106, or the like, might also be employed to support the ring structure 126. A platform (not shown) might be installed on or adjacent to the ring structure 126 or spokes 128 for mounting the radios 118, controllers 120, or other components or for use by technicians during installation or maintenance of the tower components.

One or more antenna carriages 148 are installed in the ring structure 126 such as by hingedly opening the ring structure 126 or removing a portion 212, 214 thereof, as described previously. The antenna carriages 148 are slideably disposed within the channel 134. The antenna carriages 148 can be manually moved and/or electrically or mechanically propelled to a desired position on the ring structure 126. The antenna 116 is mounted on the first end 170 of the antenna carriage 148. Before disposing the antenna carriage 148 into the channel 134, the position of communications bands 142, power bands 144, and control bands 146 in the channel 134 that are to be coupled to the antenna carriage 148 are identified. Corresponding contacts 192, 194, 196 are identified and installed or configured on the antenna carriage 148. Or a controller 234 associated with the antenna carriage 148 might be programmed to identify the corresponding bands 138/contacts 182 to be used by the antenna carriage 148 for communications, power, and control.

An antenna 116 is coupled to the antenna coupling 174 by any available means known in the art, e.g. bolts or other fasteners. The antenna 116 can be mounted before or after installation of the antenna carriage 148 into the channel 134.

A desired azimuth for aiming of the antenna 116 is identified. The antenna 116 is mounted on the antenna carriage 148 such that the antenna 116 is directed substantially outwardly from the tower along a radius of the ring structure 126. As such, a location along the ring structure 126 that corresponds with the desired azimuthal aim for the antenna 116 can also be identified. The antenna carriage 148 can thus be moved along the ring structure 126 to the identified location to achieve the desired aim of the antenna 116. A plurality of additional antennas 116 and antenna carriages 148 might also be mounted in a similar manner on the ring structure 126.

In operation, power and communications signaling is provided from the base station 104 to the corresponding radios and controllers on the tower 106. The radios and controllers subsequently provide the signaling to the antennas 116 via the appropriate power and communications bands 144, 142. One or more communications bands 142 can be used for each antenna 116 to provide the appropriate signaling thereto. Multiple signals to a single or multiple antennas 116 might be provided on a single communications band 142 or the signals might each be provided over a dedicated communications band 142. Further, all of the antennas 116 might be provided with power over a single power band 144. Or multiple power bands 144 can be employed to meet varied power needs of a variety of antennas 116 mounted on the antenna mount 114.

In an embodiment, the antenna coupling 174, as described previously, might also enable adjustment of pitch of the antenna 116. Such adjustments are made by methods known in the art. In another embodiment, the antenna coupling 174 might also provide remote azimuth steering which can also be adjusted by methods known in the art. Additionally, the RF elements in the antenna 116 itself might be adjusted to control vertical and horizontal beamwidth and vertical or horizontal lobing of the antenna signal.

At any point after installation of the antenna 116 and antenna carriage 148 on the ring structure 126 it might be determined that an adjustment of the azimuthal aim of the antenna 116 is desired. A corresponding location along the ring structure 126 is thus identified and the antenna 116 and antenna carriage 148 are moved along the channel 134 to that location to alter the aim of the antenna 116.

With reference now to FIGS. 12-15, at any point after installation of the antenna 116 and antenna carriage 148 it might be determined that the positions of a first and second antenna 116A-B need to be switched such that the first antenna 116 disposed on a first side of the second antenna 116B should be moved to a second side of the second antenna 116B. To change the positions of the antennas 116A-B, the first and second antennas 116A-B are moved to a junction 198. The first antenna 116A is moved along a first path 202A of the junction 198 while the second antenna 116B is moved along a second path 202B of the junction 198 and the two antennas 116A-B are subsequently moved out of the junction 198 such that the position of the first and second antennas 116A-B are switched following their exit.

There are multiple ways by which such a change of position might be completed depending on the starting position of the first and second antennas 116A-B and their orientation with respect to the junction 198. The following description provides examples of several such scenarios but is in no way intended to be exhaustive. Other scenarios not described herein are within the scope of embodiments of the invention.

Figure 12A:
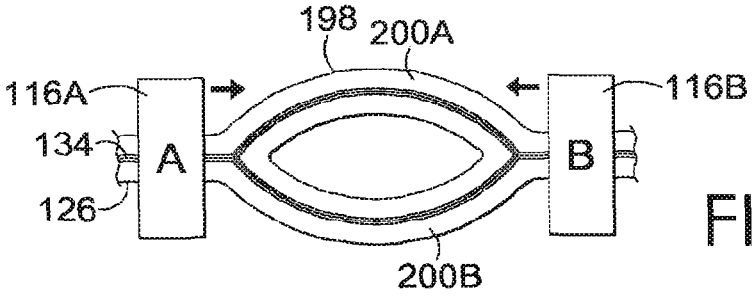
FIGS. 12A-E are elevational views depicting a progression of antennas through a junction on an antenna mount in accordance with an embodiment of the invention.

In a first example depicted in FIGS. 12A-E, the first and second antennas 116A-B are mounted on opposite sides of the junction 198 (FIG. 12A). The first antenna 116A is moved to the junction 198 from the left; the second antenna is moved to the junction 198 from the right. In order to accommodate the length of the antennas 116A-B while passing one another in the junction 198, the antenna coupling 174 and/or the antenna carriage 148 might be configured to provide rotation of the antennas 116A-B prior to entry into the junction 198, upon entry into the junction 198, or upon traversal of the junction 198.

In an embodiment, the antennas 116A-B rotate with respect to the antenna carriage 148 at the antenna coupling 174. In such an embodiment, the antenna coupling 174 might be configured with a break away that allows the antenna 116 to rotate generally about 90 degrees clockwise or counter-clockwise as depicted in FIG. 12C. In an embodiment, the antenna coupling 174 is configured rotate any desired amount to enable traversal of the junction 198 by the antennas 116A-B. The breakaway or rotation of the antenna 116 about the antenna coupling 174 can be actuated in any desired manner including manually, remotely, mechanically, magnetically, or electrically. The rotation might be provided by one or more magnetic interlocks, powered gearing, or a manual release operated by a technician. In an embodiment, a controller associated with the antenna carriage 148 automatically controls operation of the antenna 116 rotation before or during traversal of the junction 198. In an embodiment, a technician 110 via the mobile device 112 or administrator's computing device 108 can instruct rotation of the antenna 116 remotely.

In another embodiment, the antenna carriage 148 rotates upon entry or traversal of the first or second paths 200A-B of the junction 198. For example, the antenna carriage 148 rotates about an axis substantially through the body 168 of the antenna carriage 148 due to the changing course of the first or second paths 200A-B through the junction 198.

Figure 13A:
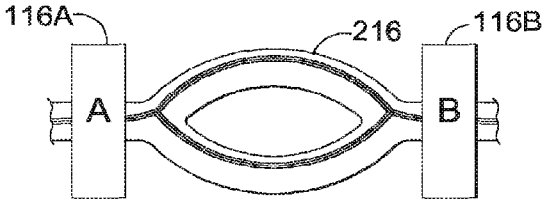
FIGS. 13A-B are elevational views depicting a progression of antennas through a junction on an antenna mount in accordance with another embodiment of the invention.
Figure 13B:
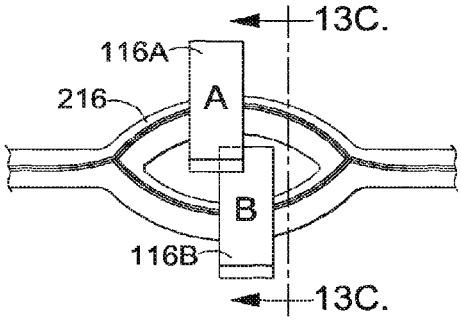
Figure 13C:
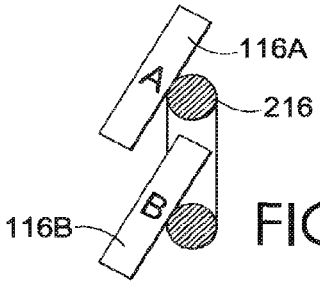
FIG. 13C is a cross sectional view along the line 13C depicted in FIG. 13B.

In another embodiment depicted in FIGS. 13A-C, the paths 200A-B of the channel 134 causes pivoting of the antenna 116 and antenna carriage 148 while traversing a junction 216. For example, the orientation of the channel 134 might twist vertically as it traverses the first or second path 200A-B of the junction 216 to cause the antenna carriage 148 and antenna 116 to pivot vertically about the ring structure 126. Thereby both the first and second antennas 116A-B traversing the first and second paths 200A-B respectively are similarly pivoted and pass one another in an overlapping manner as depicted in FIGS. 13B-C.

Figure 14A:
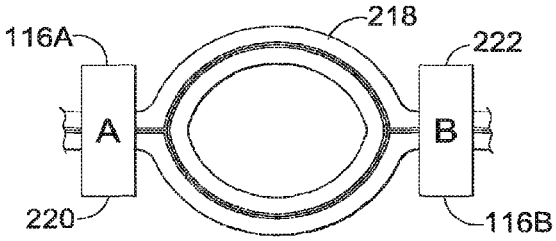
FIGS. 14A-B are elevational views depicting a progression of antennas through a vertically elongated junction on an antenna mount in accordance with an embodiment of the invention.
Figure 14B:
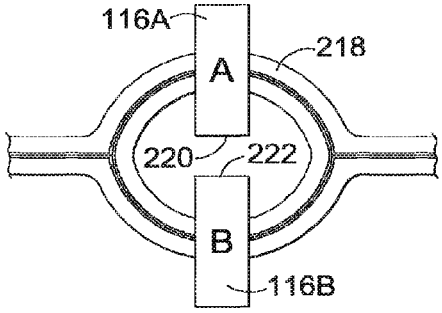

In another embodiment, a junction 218 is provided with a vertically elongated shape as depicted in FIGS. 14A-B. The elongated shape is sufficient to allow a bottom end 220 of the first antenna 116A to clear a top end 222 of the second antenna 116B as they pass in the junction 218.

Figure 12B:
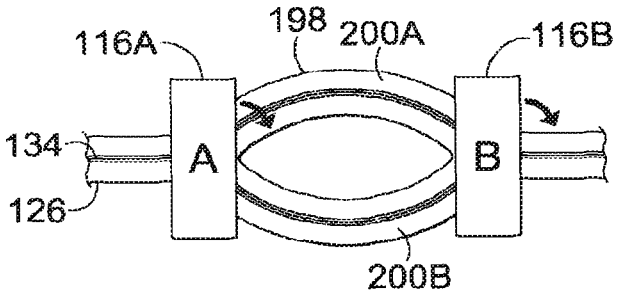
Figure 12C:
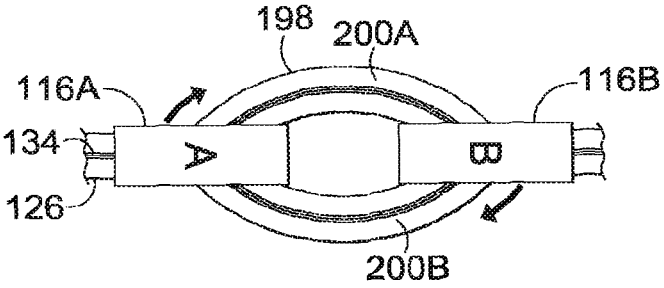
Figure 12D:
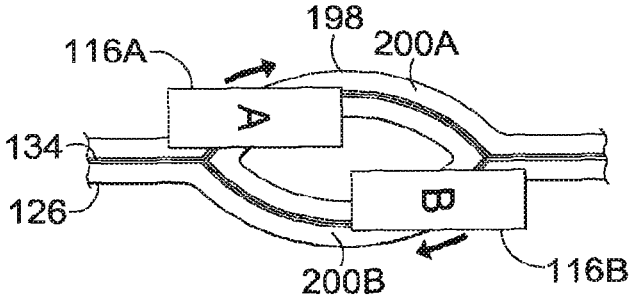
Figure 12E:
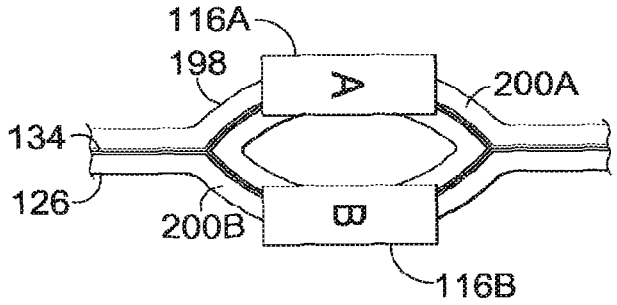
Figure 15A:
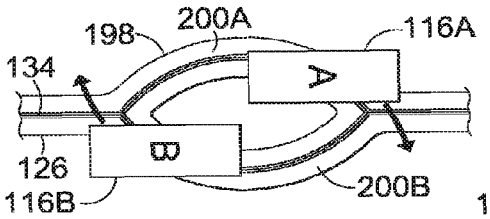
FIGS. 15A-B are elevational views of the junction of FIGS. 12A-E depicting a first way for antennas to exit the junction from their positions depicted in FIG. 12E.
Figure 15B:
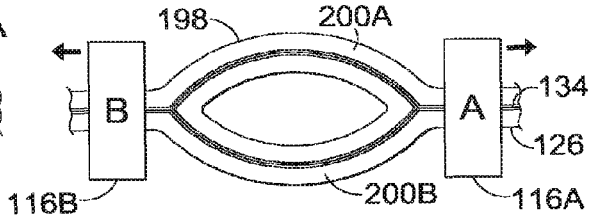

With continued reference to FIGS. 12A-E, the first and second antennas 116A-B are rotated (FIGS. 12B-C). The rotated antennas 116A-B are subsequently moved along their respective paths 200A-B to the apexes of the junction 198 (FIGS. 12D-E). The first and second antennas 116A-B may take one of three options for exiting the junction 198 to provide a desired orientation with respect to the junction 198. As depicted in FIGS. 15A-B, the first antenna 116A might continue to move toward the right while the second antenna 116B continues to move to the left. The antennas 116A-B are rotated back to their original vertical orientation at a designated location along the junction 198, upon reaching the end of the junction 198, or upon exiting the junction 198. The antennas 116A-B subsequently exit the junction on opposites sides thereof, thus resulting in the first antenna 116A being to the right of the second antenna 116B and to the right of the junction 198 while the second antenna 116B is to the left of the junction 198.

Figure 15C:
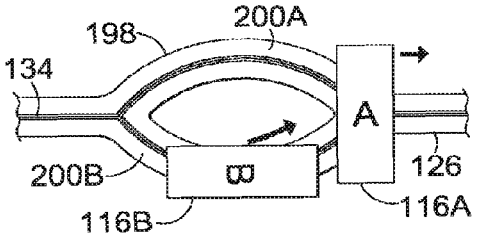
FIGS. 15C-D are elevational views of the junction of FIGS. 12A-E depicting a second way for antennas to exit the junction from their positions depicted in FIG. 12E.
Figure 15D:
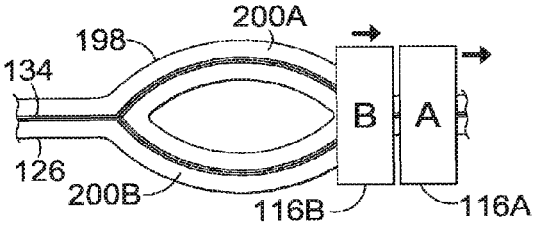
Figure 15E:
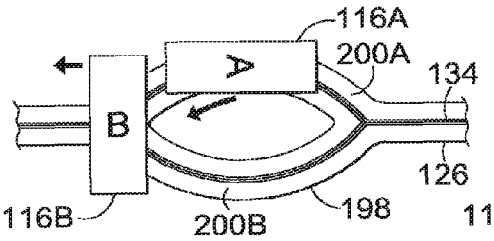
FIGS. 15E-F are elevational views of the junction of FIGS. 12A-E depicting a third way for antennas to exit the junction from their positions depicted in FIG. 12E.
Figure 15F:
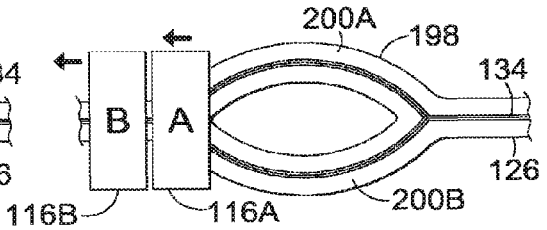

Alternatively, the antennas 116A-B might both be moved out of the same side of the junction 198. As depicted in FIGS. 15C-D, the first antenna 116A is moved out of the right side of the junction 198 and the second antenna 116B is subsequently moved out of the right side of the junction 198 to place the antennas 116A-B side-by-side and to the right of the junction. Conversely, the second antenna 116B might be moved out of the left side of the junction 198 and the first antenna 116A subsequently moved out of the left side of the junction 198, as depicted in FIGS. 15E-F. Thus, the resulting position of the antennas 116A-B is to the left of the junction 198.

Figure 16A:
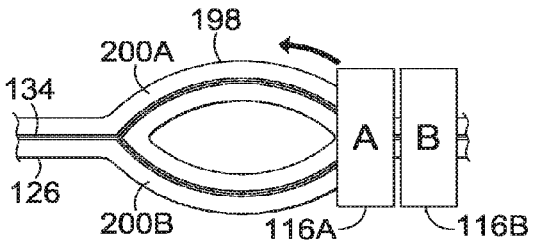
FIGS. 16A-C are elevational views of a junction on an antenna mount depicting a progression of antennas into the junction from a first side of the junction.
Figure 16B:
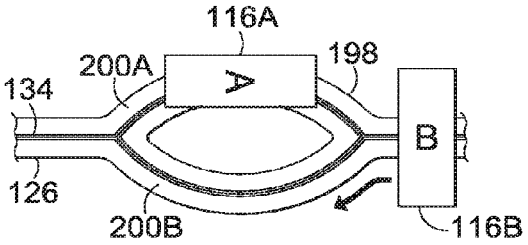
Figure 16C:
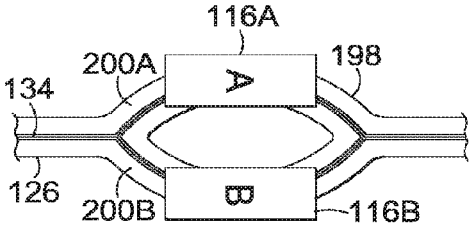
Figure 16D:
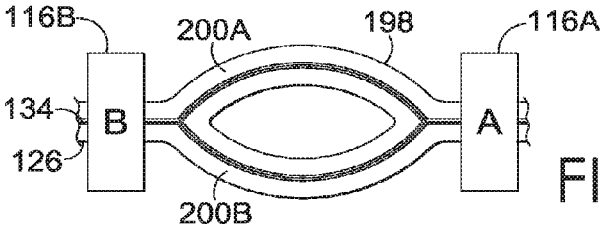
FIGS. 16D-F are elevational views depicting three optional configurations of antennas exiting the junction from their positions depicted in FIG. 16C.

In a second example, the first and second antennas 116A-B are initially positioned to the right side the junction 198. In such an example, the first antenna 116A is moved into the junction 198 along the first path 200A and the second antenna 116B is moved into the junction 198 along the second path 200B, as depicted in FIGS. 16A-C. Subsequently, in one example, the first antenna 116A pauses near a midpoint of the junction 198 while the second antenna 116B passes the first antenna 116A. The second antenna 116B exits the left side of the junction 198 while the first antenna 116A exits the right side of the junction 198 to place the second antenna 116B to the left of the first antenna 116A and on opposite sides of the junction 198 as depicted in FIG. 16D.

Figure 16E:
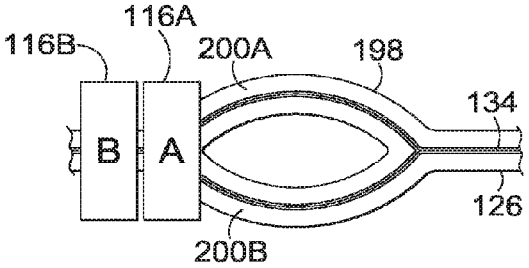

Alternatively, the second antenna 116B might continue to move through the junction 198, passing the first antenna 116A, and exiting the left side of the junction 198. The first antenna 116A subsequently exits the left side of the junction 198 to place the first antenna 116A to the right of the second antenna 116B with both antennas 116A-B to the left of the junction 198 as depicted in FIG. 16E.

Figure 16F:
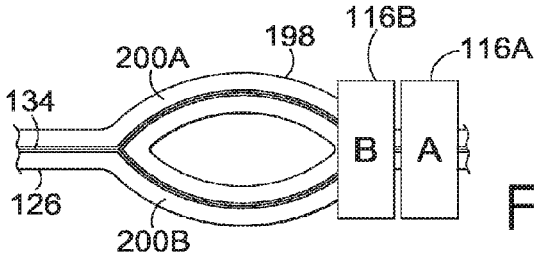

Or both antennas 116A-B might pause at the midpoint of the junction 198. The first antenna 116A might be moved back out of the right side of the junction 198 with the second antenna 116B following the first antenna 116A as depicted in FIG. 16F. The antenna's positions are thus reversed with the antennas 116A-B on the right side of the junction 198.

Figure 10A:
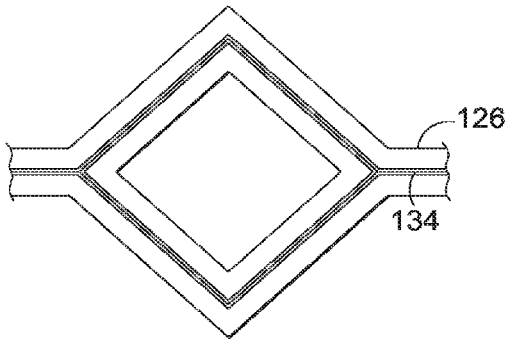
FIGS. 10A-D are elevational views of junctions on an antenna mount in accordance with embodiments of the invention.
Figure 10B:
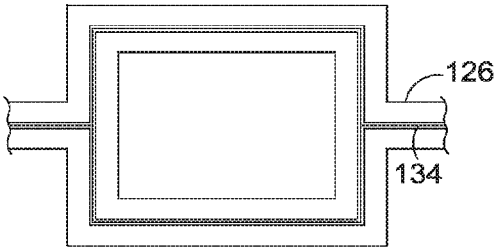
Figure 10C:
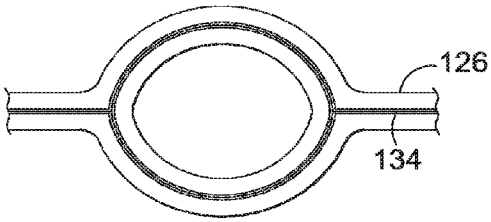
Figure 10D:
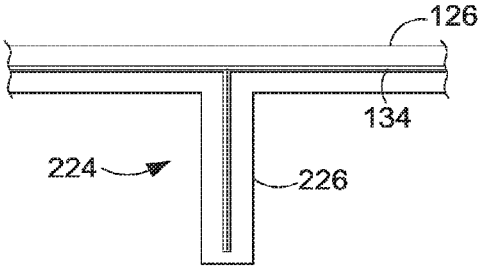

In a third example, both antennas are mounted to the same or opposite sides of a T or dogleg junction 224 depicted in FIG. 10D. The first antenna 116A is moved to the junction 224 and along a second path 226 where it pauses. Subsequently, the second antenna 116B moves past the first antenna and dogleg 226. The first antenna 116A is then moved out of the dogleg 226.

Control of movements of the antenna 116 can be conducted via remote computing device, such as the administrator's computing device 108 that communicates with the base station 104 and the tower 106 via the network 102. Control might also be completed wirelessly by the technician 110 using the wireless device 112, such as a wireless enabled laptop, PDA, or other device, at or near the tower 106. In an embodiment, a hardwired communication with the base station 104 or tower 106 might also be used. In another embodiment, the base station 104 includes the wireless transmitter 228 that communicates with the transceiver 124 mounted on the tower 106.

The control signaling provided to the antenna carriage 148, to the antenna 116, or to other components associated with the antenna mount 114 might include signaling for adjusting the pitch, rotation, and/or remote azimuth steering via an RAS antenna mount. The signaling might also include signaling for beam forming and beam steering including, but not limited to, remote electrical tilt, remote azimuthal steering, control of vertical and horizontal beamwidth, and vertical or horizontal lobing, among others.

In an embodiment, control signaling is provided in a dedicated control band 146 as described above. In another embodiment, the control signaling is embedded in communications data provided via one or more of the communications bands 142. The control signaling might be embedded in a packet header of the communications signaling on the communications band 142. The control signaling in the packet header can be recognized by the controller 120 or radio unit 118 associated with the antenna carriage 148 as such and appropriate control signals transmitted to the antenna carriage 148. In an embodiment, the control signaling is part of or is an extension to the Antenna Interface Standards Group (AISG) protocols or another currently available or later developed protocol.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A method for changing the position of antennas about a tower, the method comprising:

providing a ring structure on a tower, the ring structure including a channel that extends about a perimeter of the ring structure and a junction disposed along the perimeter at which the channel includes a first path and a second path;

mounting a first antenna on the ring structure using a first antenna carriage that fits within and that is moveable along a length of the channel;

mounting a second antenna on the ring structure using a second antenna carriage that fits within and that is moveable along the length of the channel, the second antenna being positioned along the ring structure to a first side of the first antenna;

moving the first antenna carriage into the junction and along the first path;

moving the second antenna carriage into the junction and along the second path; and moving the first and second antenna carriages out of the junction with the second antenna positioned to a second side of the first antenna, the second side being opposite the first side.

2. The method of claim 1, wherein at least one of the first antenna, the first antenna carriage, the second antenna, and the second antenna carriage is rotated before or during movement along the junction.

3. The method of claim 1, wherein the first and second antenna carriages are each moved by electromagnetic or mechanical propulsion.

4. The method of claim 1, wherein the junction comprises a diamond shape.

5. The method of claim 1, wherein the junction comprises a square or rectangular shape.

6. The method of claim 1, wherein the junction comprises an ovular shape.

7. The method of claim 1, wherein the channel includes one or more communications bands.

8. The method of claim 1, wherein the channel includes a hinged flange for selectively steering the first and second antenna mounts onto the first path or the second path.

9. The method of claim 1, wherein the ring structure includes at least one hinge for pivoting a portion of the ring structure away from the ring structure to expose the channel.

10. The method of claim 1, wherein a portion of the ring structure is removable to expose the channel.

* * * * *